US005623796A

United States Patent [19]

McCabe

[11] Patent Number: 5,623,796

[45] Date of Patent: Apr. 29, 1997

[54] METHOD AND APPARATUS FOR MOUNTING A FIRE DAMPER

[76] Inventor: Francis J. McCabe, #6 Bunker Hill Rd., Ottsville, Pa. 18942

[21] Appl. No.: 625,795

[22] Filed: Mar. 29, 1996

[51] Int. Cl.[6] ..... E04C 2/52

[52] U.S. Cl. ..... 52/220.8; 52/745.16; 454/369; 285/189

[58] Field of Search ..... 52/220.8, 745.15, 52/745.16, 208, 213, 507; 249/39; 285/205, 189; 454/369, 271

[56] References Cited

U.S. PATENT DOCUMENTS

| | | | |
|---|---|---|---|
| 1,141,493 | 6/1915 | Scherer . | |
| 1,643,863 | 9/1927 | Truax . | |
| 1,769,725 | 7/1930 | Truax . | |
| 3,129,751 | 4/1964 | Weber . | |
| 3,273,632 | 9/1966 | McCabe . | |
| 3,401,734 | 9/1968 | McCabe . | |
| 3,575,229 | 4/1971 | Alley . | |
| 3,727,663 | 4/1973 | McCabe . | |
| 4,037,563 | 7/1977 | Pflueger et al. | 52/208 X |
| 4,515,068 | 5/1985 | Van Becelaere | 285/189 X |
| 4,524,678 | 6/1985 | Klebanoff | 454/369 |
| 4,579,047 | 4/1986 | Zielinski . | |
| 4,903,934 | 2/1990 | Fremstad . | |
| 5,171,184 | 12/1992 | Saucier et al. . | |

*Primary Examiner*—Carl D. Friedman
*Assistant Examiner*—Timothy B. Kang
*Attorney, Agent, or Firm*—Frank J. Benasutti

[57] ABSTRACT

A damper is provided with a plurality of lugs on one side opposite to its face which lugs can be rotated to interfere with removing the damper from the wall in which it is mounted. The lugs can be rotated from the outside and fastened in position without having to go around the wall.

4 Claims, 2 Drawing Sheets

METHOD AND APPARATUS FOR MOUNTING A FIRE DAMPER

TECHNICAL FIELD

This invention relates to improvements in the means for and methods of mounting a fire damper in duct work, and, in particular, to an apparatus and method for mounting such a damper in a masonry or dry wall installation of a given standard thickness.

BACKGROUND ART

Fire dampers, as shown, for example, in my U.S. Pat. Nos. 3,273,632 and 3,401,734, are commonly mounted in inner walls and partitions and the like in buildings and are connected to the air duct work. In the prior art, the ordinary means for accomplishing this mounting and positioning was to place a sleeve about the fire damper, attach the sleeve to the fire damper frame, position the sleeve in the wall so that an outwardly extending flange of the sleeve abutted one surface of the wall; then position a separate piece of angle iron against the opposite face of the wall, and then bolt the sleeve to the angle iron. It was then necessary to provide a separate adapter means to attach the sleeve to the air duct work. In my prior art U.S. Pat. No. 3,727,663, I describe and claim an adapter means improvement on this prior art. Therein, the prior art just described is shown by the angle iron 20 attached to the sleeve in the upper left hand corner of FIG. 1*a* of the drawings. In the '663 Patent, the device comprises one or more sheet metal members co-extensive with a portion of the fire damper, which have been bent to engage the wall and the duct work.

In cases where the damper and sleeve are inserted through a wall and the other duct work is not in place, it is possible to go to the opposite side of the wall to place the angle iron in position and attach it to the sleeve as aforesaid. However, if the vertical portion of the duct work (known as a vertical chase) is in place, it is not possible to do that which has just been described and, accordingly, often dampers are merely placed in position on one side of the wall without attachment from the other side of the wall.

I have observed that masonry and dry wall construction is standardized in new construction in terms of their thickness. Thus, it is possible to predict the size of the depth of the frame of the fire damper within an acceptable degree of accuracy for purposes of mounting the fire damper.

I have also noted that the fire underwriters tests and actual fire conditions require that the fire damper be retained under the changing dynamic pressure conditions of a fire, so that the damper is not blown out of the wall. In other words, it is simply not enough to mount a damper, but the damper must be able to be retained within the wall during extreme pressure changing conditions. The present invention is directed to an apparatus and method for accomplishing that mounting in a simple and effective manner. Indeed, the present invention provides the only means of effectively mounting the damper from one side of a wall under conditions in which a vertical chase is already in place.

SUMMARY OF INVENTION

The present invention comprises the plurality of rotatable lugs mounted at spaced intervals along the face of the frame of the damper remote from the retaining flat outer flange of the damper. These lugs provide a means whereby the damper cab be slid into place and then the lugs can be rotated to lock the damper in place.

Accordingly, it is an object of this invention to provide a means which eliminates costly parts and labor in the installation of a fire damper and which, at the same time, provides a means which is safe and effective for the purposes described above.

This and other objects of the invention will become apparent from the following description with reference to the accompanying drawings.

DISCLOSURE OF THE INVENTION

DESCRIPTION OF THE PREFERRED EMBODIMENTS

Figure 1:
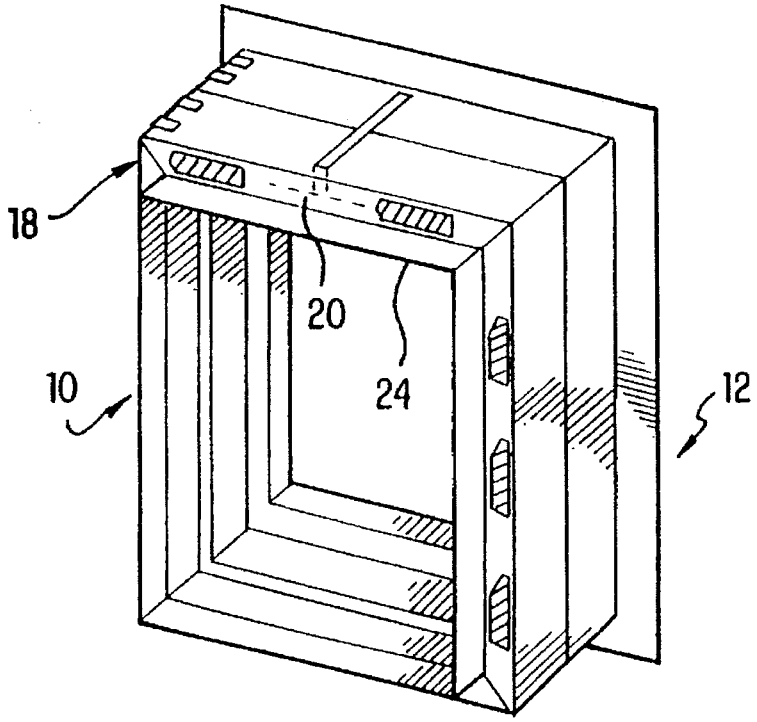
FIG. 1 is a perspective view of a fire damper in accordance with the preferred embodiment of my invention shown prior to its placement in its useful environment.

I have shown in FIG. 1 a fire damper, designated generally 10, in a perspective view before mounting in the wall of a building. The damper will typically have a transversely extending flange extending outwardly from one face of the damper to provide for its positioning and support against one face, the outer face, of an opening in a wall. That flange is designated generally 12.

Figure 2A:
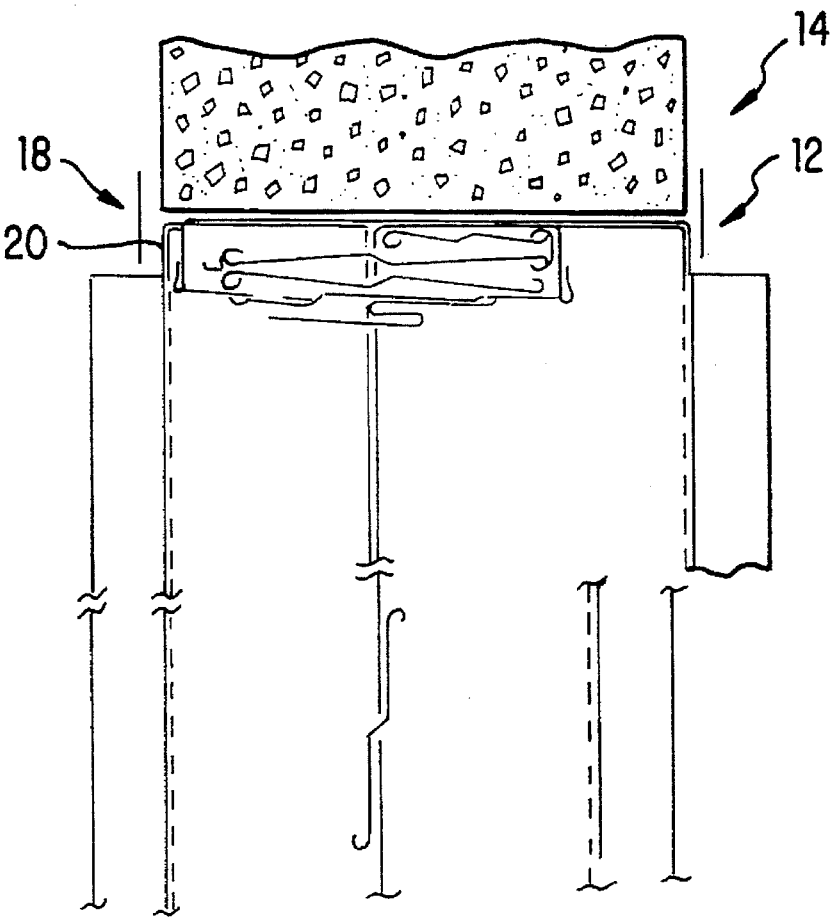
FIGS. 2*a* and 2*b* are cross sections showing the damper of FIG. 1 in place in its useful environment, partially broken away to show alternate environments.
Figure 2B:
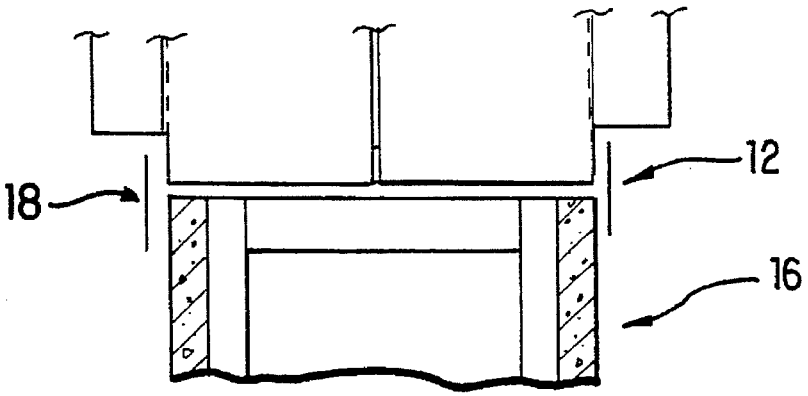

Referring to FIGS. 2*a* and 2*b*, which show a cross-sectional view, it will be noted that the flange 12 would fit against the face of the masonry construction shown in FIG. 2*a* or the dry wall construction shown in FIG. 2*b*; the masonry being illustrated as designated generally 14 and the dry wall designated generally 16.

Figure 3:
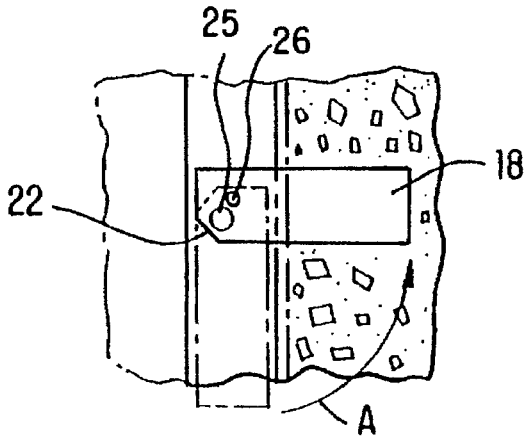
FIG. 3 is an enlarged plan view of a portion of my invention showing alternate positions of parts.

To retain the damper in place under adverse conditions, I have provided a plurality of lugs designated generally 18, FIG. 1, at spaced intervals about an inwardly depending, transversely extending flange 20 of the fire damper. This flange is spaced from the flange 12 to correspond to the width of a standard new construction masonry or dry wall width as shown in FIGS. 2*a* and 2*b*, respectively. Thus, the depth of the damper corresponds to the width of the wall. Since I have mounted the lugs so that they can be rotatable, it will be appreciated that once they are rotated from, for example, the position shown in dotted lines in FIG. 3 to the position shown on the solid lines in FIG. 3 and FIG. 2, one surface of the lugs will abut in sliding fashion a surface of the wall, whether masonry or dry wall, opposite to the surface engaged by the flange 12; and thus prevent egress of the damper from the hole in the wall.

To retain lugs 18 in position, I have provided the following means. First, the lug is pivotally mounted on the flange 20 as by means of riveting with a loose tolerance, so that the lug can be rotated by hand or with a screw driver. The leading end corner 22 is relieved as, for example, by the break or bevel shown in FIG. 3, so that as the lug is pivoted, it will clear the longitudinally extending additional framing member 24 when the lug is rotated as shown by the Arrows A, FIG. 3. On rotation of the lug, a sheet metal screw is passed through a pre-existing hole in the damper and a corresponding pre-existing hole in the lug, as shown at 26; said hole being of such a diameter that the threads of the sheet metal screw will engage the hole and bite into the metal of the lug so as to retain the lug in its rotated position. Typically, dampers are constructed of 18 gauge material and the lugs may be of 16 gauge material, such as galvanized steel.

METHOD OF OPERATION

From what has been described, it will be apparent that in operation a damper is selected having the same frame depth as the width of the wall in which it is to be mounted; then the damper is inserted into that wall with the lugs in a non-interfering position with the opening in the wall; insertion continuing until the outwardly extending flange on the outside of the damper engages the surface of the wall into which the damper is being inserted; and then the lugs are rotated approximately 90 degrees into an interfering position with the egress of the damper from the hole in which it has been inserted; and then fastening means, such as screws, are inserted through the inwardly depending flange of the damper upon which the lugs are mounted and through the lugs themselves in a fastening engagement so as to prevent rotation of the lugs back to their non-interfering position.

The invention claimed is:

1. A fire damper mounting means comprising: a frame; a transversely extending outer flange attached to said frame for engagement with a first exterior surface of a wall surrounding a hole into which said fire damper is to be mounted; lug means comprising a plurality of rotatable lugs mounted on said frame at spaced intervals along a face of said frame remote from and in a plane parallel to the outer flange of said frame; said rotatable lugs being so positioned as to be capable of being rotated about an axis from a position of non-interference with the exterior surfaces of the wall forming the hole into which said damper is to be mounted, into an interfering position with a second exterior surface of the wall forming said hole, so as to be juxtaposed to the second surface of said wall upon rotation thereof to prevent said fire damper from being withdrawn from said hole; and fastening means for engaging said frame and said lugs to prevent said lugs from being rotated to a non-interfering position once they have been rotated to a position of interference with the egress of said damper from said hole.

2. The invention of claim 1 wherein, said lug means further comprises a hole spaced from said axis; and said frame comprises a hole equally spaced from said axis, so that said fastening means can be inserted through said hole in said frame and into said hole in said lug means to retain said lug means in its rotated position.

3. The invention of claim 2 wherein the lugs further comprise an external configuration allowing the lugs to be pivoted as aforesaid without interference with other portions of said frame.

4. A method of mounting a fire damper in a hole in a wall, comprising: selecting a damper having a frame having the same frame depth as the thickness of the wall in which the damper is to be mounted, said frame having a plurality of rotatable lugs mounted thereon and having an outwardly extending external flange; inserting the damper into said hole in said wall with the lugs in a non-interfering position with the hole in the wall; insertion continuing until the outwardly extending flange on the outside of the damper engages a surface of the wall forming the hole into which the damper is being inserted; then rotating the lugs into an interfering position which prevents egress of the damper from the hole in which it has been inserted; and then inserting a fastening means through the damper frame and through the lugs themselves in a fastening engagement so as to prevent rotation of the lugs back to their non-interfering position.

* * * * *